US007803268B2

(12) United States Patent
Orth et al.

(10) Patent No.: US 7,803,268 B2
(45) Date of Patent: Sep. 28, 2010

(54) METHOD AND PLANT FOR PRODUCING LOW-TEMPERATURE COKE

(75) Inventors: Andreas Orth, Friedrichsdorf (DE); Martin Hirsch, Friedrichsdorf (DE); Peter Weber, Kronberg-Schönberg (DE)

(73) Assignee: Outotec Oyj, Espoo (FI)

( * ) Notice: Subject to any disclaimer, the term of this patent is extended or adjusted under 35 U.S.C. 154(b) by 584 days.

(21) Appl. No.: 10/540,073

(22) PCT Filed: Dec. 1, 2003

(86) PCT No.: PCT/EP03/13501

§ 371 (c)(1),
(2), (4) Date: Jul. 19, 2006

(87) PCT Pub. No.: WO2004/056941

PCT Pub. Date: Jul. 8, 2004

(65) Prior Publication Data

US 2006/0278566 A1 Dec. 14, 2006

(30) Foreign Application Priority Data

Dec. 23, 2002 (DE) ..... 102 60 734

(51) Int. Cl.
*C10G 9/14* (2006.01)
*B01J 8/18* (2006.01)

(52) U.S. Cl. ..... 208/131; 422/139; 263/21; 122/4 D; 75/447; 75/450

(58) Field of Classification Search ..... 208/131; 75/447, 450; 122/4 D; 263/21; 422/139; 423/439

See application file for complete search history.

(56) References Cited

U.S. PATENT DOCUMENTS 2,485,317 A 10/1949 Roetheli (Continued)

FOREIGN PATENT DOCUMENTS

AU 9894057 A1 5/2000

(Continued)

OTHER PUBLICATIONS

English abstract of German Application No. 101 01 157.

(Continued)

*Primary Examiner*—Glenn Caldarola
*Assistant Examiner*—Prem C. Singh
(74) *Attorney, Agent, or Firm*—Leydig, Voit & Mayer, Ltd.

(57) ABSTRACT

The present invention relates to a method and a plant for producing low 15 temperature coke, in which granular coal and possibly further solids are heated to a temperature of 700 to 1050° C. in a fluidized-bed reactor (2) by means of an oxygen-containing gas. To improve the utilization of energy it is proposed to introduce a first gas or gas mixture from below through at least one gas supply tube (3) into a mixing chamber region (8) of the reactor (2), the gas supply tube (3) being at least partly surrounded by a stationary annular fluidized bed (6) which is fluidized by supplying fluidizing gas. The gas velocities of the first gas or gas mixture and of the fluidizing gas for the annular fluidized bed (6) are adjusted such that the Particle-Froude-Numbers in the gas supply tube (3) are between 1 and 100, in the annular fluidized bed (6) between 0.02 and 2 and in the 25 mixing chamber (8) between 0.3 and 30.

19 Claims, 2 Drawing Sheets

U.S. PATENT DOCUMENTS

| | | | | |
|---|---|---|---|---|
| 2,582,710 | A | | 1/1952 | Martin ..... 48/206 |
| 2,607,666 | A | | 8/1952 | Martin ..... 48/62 |
| 2,714,126 | A | | 7/1955 | Keith |
| 2,826,460 | A | | 3/1958 | Cameron et al. |
| 2,864,674 | A | | 12/1958 | King |
| 2,874,095 | A | | 2/1959 | Boisture et al. ..... 202/25 |
| 2,901,421 | A | | 8/1959 | Bourguet et al. |
| 3,528,179 | A | | 9/1970 | Smith |
| 3,565,408 | A | | 2/1971 | Lothar et al. |
| 3,578,798 | A | | 5/1971 | Lapple et al. |
| 3,671,424 | A | | 6/1972 | Saxton ..... 208/127 |
| 3,876,392 | A | | 4/1975 | Kalina et al ..... 48/210 |
| 3,884,620 | A | | 5/1975 | Rammler |
| 3,995,987 | A | | 12/1976 | MacAskill |
| 4,044,094 | A | | 8/1977 | Barner et al. |
| 4,073,642 | A | | 2/1978 | Collin et al. |
| 4,080,437 | A | | 3/1978 | Reh et al. |
| 4,091,085 | A | | 5/1978 | Reh et al. |
| 4,191,544 | A | | 3/1980 | Boll et al. |
| 4,338,283 | A | | 7/1982 | Sakamoto et al. |
| 4,377,466 | A | | 3/1983 | Wallman ..... 208/11 |
| 4,402,754 | A | | 9/1983 | Schmidt et al. |
| 4,404,755 | A | | 9/1983 | Stewart et al. |
| 4,490,287 | A | | 12/1984 | Hardwick et al. |
| 4,545,132 | A | | 10/1985 | Li et al. |
| 4,555,388 | A | | 11/1985 | Hundebol |
| 4,676,824 | A | | 6/1987 | Daradimos et al. |
| 4,716,856 | A | * | 1/1988 | Beisswenger et al. ..... 122/4 D |
| 4,786,477 | A | | 11/1988 | Yoon et al. |
| 4,789,580 | A | | 12/1988 | Hirsch et al. ..... 423/49 |
| 4,795,547 | A | | 1/1989 | Barnes |
| 4,806,158 | A | | 2/1989 | Hirsch et al. |
| 4,817,563 | A | | 4/1989 | Beisswenger et al. |
| 4,822,592 | A | | 4/1989 | Misra |
| 4,919,715 | A | | 4/1990 | Smith et al. |
| 4,992,245 | A | | 2/1991 | Van Slooten et al. |
| 5,033,413 | A | | 7/1991 | Zenz et al. |
| 5,205,350 | A | | 4/1993 | Hirsch et al. |
| 5,269,236 | A | | 12/1993 | Okuno et al. |
| 5,349,154 | A | | 9/1994 | Harker et al. |
| 5,374,413 | A | | 12/1994 | Kim et al. |
| 5,382,412 | A | | 1/1995 | Kim et al. |
| 5,382,418 | A | | 1/1995 | Thöne et al. |
| 5,437,850 | A | | 8/1995 | Kroehl et al. |
| 5,505,907 | A | | 4/1996 | Hiltunen et al. |
| 5,527,379 | A | | 6/1996 | Hirsch et al. |
| 5,560,762 | A | * | 10/1996 | Bresser et al. ..... 75/447 |
| 5,573,689 | A | | 11/1996 | Fukuoka et al. |
| 5,603,748 | A | | 2/1997 | Hirsch et al. |
| 5,783,158 | A | | 7/1998 | Tacke et al. |
| 5,942,110 | A | | 8/1999 | Norris |
| 6,007,869 | A | | 12/1999 | Schreieder et al. |
| 6,015,539 | A | | 1/2000 | Schmidt et al. |
| 6,022,513 | A | | 2/2000 | Pecoraro et al. |
| 6,074,533 | A | | 6/2000 | Tranquilla |
| 6,110,413 | A | | 8/2000 | Jung et al. |
| 6,197,234 | B1 | | 3/2001 | Goundmand et al. |
| 6,368,389 | B1 | | 4/2002 | Birke et al. |
| 6,395,248 | B1 | | 5/2002 | Kim et al. |
| 6,413,477 | B1 | | 7/2002 | Govoni et al. |
| 6,416,721 | B1 | | 7/2002 | Sanjurjo et al. |
| 6,827,786 | B2 | | 12/2004 | Lord |
| 7,526,923 | B2 | | 5/2009 | Lothe |
| 2004/0056465 | A1 | | 3/2004 | Lagsdin |
| 2006/0162500 | A1 | | 7/2006 | Nuber et al. |
| 2006/0230879 | A1 | | 10/2006 | Stroder et al. |
| 2006/0230880 | A1 | | 10/2006 | Hirsch et al. |
| 2006/0231433 | A1 | | 10/2006 | Rufo, Jr. et al. |
| 2006/0231466 | A1 | | 10/2006 | Nuber |
| 2006/0249100 | A1 | | 11/2006 | Freytag et al. |
| 2006/0263292 | A1 | | 11/2006 | Hirsch et al. |
| 2006/0278566 | A1 | | 12/2006 | Orth et al. |
| 2007/0137435 | A1 | | 6/2007 | Orth et al. |
| 2008/0124253 | A1 | | 5/2008 | Schmidt et al. |

FOREIGN PATENT DOCUMENTS

| | | | |
|---|---|---|---|
| CN | 1732276 | A | 2/2006 |
| CN | 1738918 | A | 2/2006 |
| DE | 101 6938 | | 7/1953 |
| DE | 2805906 | | 8/1979 |
| DE | 3235559 | | 5/1984 |
| DE | 2524541 | | 8/1986 |
| DE | 2624302 | | 4/1987 |
| DE | 248 109 | | 7/1987 |
| DE | 3822999 | | 1/1990 |
| DE | 278 348 | | 5/1990 |
| DE | 40 15031 | | 11/1991 |
| DE | 41 03 965 | | 4/1992 |
| DE | 42 06602 | | 6/1993 |
| DE | 44 10093 | | 3/1994 |
| DE | 196 09284 | | 9/1997 |
| DE | 19841513 | | 5/1999 |
| DE | 198 13 286 | A1 | 9/1999 |
| DE | 694 16458 | | 9/1999 |
| DE | 694 17103 | | 9/1999 |
| DE | 101 01 157 | | 7/2002 |
| DE | 100 61386 | | 9/2002 |
| DE | 101 64086 | | 8/2003 |
| EP | 0246191 | | 11/1987 |
| EP | 0 534 243 | | 3/1993 |
| EP | 0 575 245 | | 12/1993 |
| EP | 0 630 975 | | 6/1994 |
| EP | 0 630 683 | | 12/1994 |
| EP | 0 748 391 | | 12/1996 |
| EP | 0 995 065 | | 10/2002 |
| GB | 915412 | | 1/1963 |
| GB | 951245 | | 3/1964 |
| GB | 1 502 576 | | 3/1978 |
| WO | WO 98/08989 | | 3/1989 |
| WO | WO 89/09290 | | 10/1989 |
| WO | WO 90/11824 | | 10/1990 |
| WO | WO 01/44719 | | 6/2001 |
| WO | WO 02/055744 | | 7/2002 |
| WO | WO-2004056467 | | 7/2004 |

OTHER PUBLICATIONS

English abstract of German Application No. 278 348.

Vijay, "Preoxidation and Hydrogen Reduction of Ilmenite in a Fluidized Bed Reactor" XP000632260, Metallurgical and Materials Transactions B, vol. 27B, Oct. 1996 pp. 731-738.

U.S. Appl. No. 10/540,436, filed Nov. 10, 2005, Dirk Nuber et al.

U.S. Appl. No. 10/540,438, filed Jun. 6, 2006, Jochen Freytag et al.

U.S. Appl. No. 10/540,437, filed May 10, 2006, Michael Ströder et al.

U.S. Appl. No. 10/540,435, filed Mar. 27, 2006, Andreas Orth et al.

U.S. Appl. No. 10/540,376, filed Jan. 17, 2006, Dirk Nuber et al.

U.S. Appl. No. 10/540,434, filed May 16, 2006, Martin Hirsch et al.

U.S. Appl. No. 10/540,497, filed May 31, 2006, Michael Ströder et al.

U.S. Appl. No. 10/540,352, filed Mar. 24, 2006, Michael Ströder et al.

U.S. Appl. No. 10/540,071, filed May 11, 2006, Martin Hirsch et al.

Kim Y.T., et al. "Entrainment of solids in an internally circulating fluidized bed with draft tube", Chemical Engineering Journal, vol. 66, (1997), p. 105-110.

* cited by examiner

METHOD AND PLANT FOR PRODUCING LOW-TEMPERATURE COKE

This application claims the benefit of International Application No. PCT/EP2003/013501 filed on Dec. 1, 2003 under 35 U.S.C. §371, entitled, "Method and Plant for Producing Low-Temperature Coke" which claims the benefit of German Patent Application No. 102 60 734.6 filed on Dec. 23, 2002.

TECHNICAL FIELD

The present invention relates to a method for producing low-temperature coke, in which granular coal and possibly further solids are heated to a temperature of 700 to 1050° C. in a fluidized-bed reactor by means of an oxygen-containing gas, and to a corresponding plant.

Such methods and plants are used for instance for producing low-temperature coke or for producing a mixture of low-temperature coke and ores, for instance iron ores. In the latter case, granular ore is supplied to the low-temperature carbonization reactor apart from granular coal. The low-temperature coke produced in this way, or the mixture of low-temperature coke and ore, can then be processed for instance in a succeeding smelting process.

From DE 101 01 157 A1 there is known a method and a plant for producing a hot, granular mixture of iron ore and low-temperature coke, in which granular coal and preheated iron ore are charged to a low-temperature carbonization reactor, and in which temperatures In the range from 800 to 1050° C. are generated by supplying oxygen-containing gas and by partial oxidation of the constituents of the coal, the granular solids being maintained in a turbulent movement and being supplied from the upper region of the reactor to a solids separator. The low-temperature carbonization reactor can constitute a fluidized-bed reactor, and it is left open whether the method can be performed with a stationary or a circulating fluidized bed. To minimize the energy demand of the plant, it is furthermore proposed to preheat the iron ore before supplying the same to the low-temperature carbonization reactor with the hot exhaust gases of the solids separator. However, the product quality to be achieved with this method, which in particular depends on the mass and heat transfer conditions, needs improvement. In the case of the stationary fluidized bed, this is chiefly due to the fact that although very long solids retention times are adjustable, the mass and heat transfer is rather moderate due to the comparatively low degree of fluidization, and dust-laden exhaust gas, e.g. from the product cooling, can hardly be integrated in the process. Circulating fluidized beds, on the other hand, have better mass and heat transfer conditions due to the higher degree of fluidization, but are restricted in terms of their retention time because of this higher degree of fluidization.

SUMMARY OF THE INVENTION

Therefore, it is the object of the present invention to provide a method for producing low-temperature coke, which can be performed more efficiently and is characterized in particular by a good utilization of energy.

In accordance with the invention, this object is solved by a method as mentioned above, in which a first gas or gas mixture is introduced from below through a gas supply tube (central tube) into a mixing chamber region of the reactor, the central tube being at least partly surrounded by a stationary annular fluidized bed which is fluidized by supplying fluidizing gas, and in which the gas velocities of the first gas or gas mixture as well as of the fluidizing gas for the annular fluidized bed are adjusted such that the Particle-Froude-Numbers in the central tube are between 1 and 100, in the annular fluidized bed between 0.02 and 2 and in the mixing chamber between 0.3 and 30.

In the method of the invention, the advantages of a stationary fluidized bed, such as a sufficiently long solids retention time, and the advantages of a circulating fluidized bed, such as a good mass and heat transfer, can surprisingly be combined with each other during the heat treatment, while the disadvantages of both systems are avoided. When passing through the upper region of the central tube, the first gas or gas mixture entrains solids from the annular stationary fluidized bed, which is referred to as annular fluidized bed, into the mixing chamber, so that due to the high slip velocities between solids and gas an intensively mixed suspension is formed and an optimum heat transfer between the two phases is achieved.

As a result of the reduction of the flow velocity of the first gas or gas mixture upon leaving the central tube and/or as a result of the impingement on one of the reactor walls, a large part of the solids is precipitated from the suspension in the mixing chamber and falls back into the stationary annular fluidized bed, whereas only a small amount of non-precipitated solids is discharged from the mixing chamber together with the first gas or gas mixture. Thus, a solids circulation is obtained between the reactor regions of the stationary annular fluidized bed and the mixing chamber. Due to the sufficient retention time on the one hand and the good mass and heat transfer on the other hand, a good utilization of the thermal energy introduced into the low-temperature carbonization reactor and an excellent product quality is thus obtained. Another advantage of the method of the invention consists in the possibility of operating the process under partial load without a loss in product quality.

To ensure a particularly effective mass and heat transfer in the mixing chamber and a sufficient retention time in the reactor, the gas velocities of the first gas mixture and of the fluidizing gas are preferably adjusted for the fluidized bed such that the dimensionless Particle-Froude-Numbers ($Fr_P$) in the central tube are 1.15 to 20, in the annular fluidized bed 0.115 to 1.15 and/or in the mixing chamber 0.37 to 3.7. The Particle-Froude-Numbers are each defined by the following equation:

$$Fr_P = \frac{u}{\sqrt{\frac{(\rho_s - \rho_f)}{\rho_f} * d_p * g}}$$

with u=effective velocity of the gas flow in m/s $\rho_s$=density of a solid particle in kg/m$^3$ $\rho_f$=effective density of the fluidizing gas in kg/m$^3$ $d_p$=mean diameter in m of the particles of the reactor inventory (or the particles formed) during operation of the reactor g=gravitational constant in m/s$^2$.

When using this equation it should be considered that $d_p$ does not indicate the grain size ($d_{50}$) of the material supplied to the reactor, but the mean diameter of the reactor inventory formed during the operation of the reactor, which can differ significantly in both directions from the mean diameter of the material used (primary particles). From very fine-grained material with a mean diameter of 3 to 10 μm, particles (secondary particles) with a grain size of 20 to 30 μm are formed for instance during the heat treatment. On the other hand, some materials, e.g. certain ores, are decrepitated during the heat treatment.

In accordance with a development of the invention it is proposed to recirculate part of the solids discharged from the reactor and separated in a separator, for instance a cyclone, into the annular fluidized bed. The amount of the product stream recirculated into the annular fluidized bed preferably is controlled in dependence on the pressure difference above the mixing chamber. In dependence on the solids supply, the grain size and the gas velocity a level is obtained in the mixing chamber, which can be influenced by splitting the withdrawal of product from the annular fluidized bed and from the separator.

To achieve a good fluidization of the coal, coal with a grain size of less than 10 mm, preferably less than 6 mm, is supplied to the low-temperature carbonization reactor as starting material.

Highly volatile coals, such as lignite, which can possibly also contain water, turned out to be particularly useful starting materials for the method in accordance with the invention.

As fluidizing gas, air is preferably supplied to the low-temperature carbonization reactor, and for this purpose all other gases or gas mixtures known to the expert for this purpose can of course also be used.

It turned out to be advantageous to operate the low-temperature carbonization reactor at a pressure of 0.8 to 10 bar and particularly preferably between 2 and 7 bar.

The method in accordance with the invention is not restricted to the production of low-temperature coke, but in accordance with a particular embodiment can also be used for producing a mixture of ore and low-temperature coke by simultaneously supplying other solids to the low-temperature carbonization reactor. The method in accordance with the invention turned out to be particularly useful for producing a mixture of iron ore and low-temperature coke.

In this embodiment, the iron ore is expediently first preheated in a preheating stage, comprising a heat exchanger and a downstream solids separator, for instance a cyclone, before being supplied to the low-temperature carbonization reactor. With this embodiment, mixtures of iron ore and low-temperature coke with an Fe:C weight ratio of 1:1 to 2:1 can be produced.

In accordance with a development of the invention it is proposed to heat the iron ore in the suspension heat exchanger by means of exhaust gas from a cyclone downstream of the reactor. In this way, the total energy demand of the process is further reduced.

Furthermore, the present invention relates to a plant which is in particular suited for performing the method described above.

In accordance with the invention, the plant includes a reactor constituting a fluidized-bed reactor for the low-temperature carbonization of granular coal and possibly further solids. In the reactor, a gas supply system is provided, which extends into the mixing chamber of the reactor and is formed such that gas flowing through the gas supply system entrains solids from a stationary annular fluidized bed, which at least partly surrounds the gas supply system, into the mixing chamber. Preferably, this gas supply system extends into the mixing chamber. It is, however, also possible to let the gas supply system end below the surface of the annular fluidized bed. The gas is then introduced into the annular fluidized bed e.g. via lateral apertures, entraining solids from the annular fluidized bed into the mixing chamber due to its flow velocity.

In accordance with the invention, the gas supply system has a gas supply tube (central tube) extending upwards substantially vertically from the lower region of the reactor preferably into the mixing chamber of the reactor, which gas supply tube is at least partly surrounded by a chamber in which the stationary annular fluidized bed is formed. The central tube can constitute a nozzle at its outlet opening and have one or more apertures distributed around its shell surface, so that during the operation of the reactor solids constantly get into the central tube through the apertures and are entrained by the first gas or gas mixture through the central tube into the mixing chamber. Of course, two or more gas supply tubes with different or identical dimensions may also be provided in the reactor.

Preferably, however, at least one of the gas supply tubes is arranged approximately centrally with reference to the cross-sectional area of the reactor.

In accordance with a preferred embodiment, a cyclone for separating solids is provided downstream of the reactor.

To provide for a reliable fluidization of the solids and the formation of a stationary fluidized bed, a gas distributor is provided in the annular chamber of the low-temperature carbonization reactor, which divides the chamber into an upper annular fluidized bed and a lower gas distributor, the gas distributor being connected with a supply conduit for fluidizing gas and/or gaseous fuel. The gas distributor can constitute a gas distributor chamber or a gas distributor composed of tubes and/or nozzles, where part of the nozzles can each be connected to a gas supply for fluidizing gas and another part of the nozzles can be connected to a separate gas supply of gaseous fuel.

In accordance with a development of the invention it is proposed to provide a preheating stage including a suspension heat exchanger and a cyclone downstream of the same upstream of the low-temperature carbonization reactor.

In the annular fluidized bed and/or the mixing chamber of the reactor, means for deflecting the solid and/or fluid flows can be provided in accordance with the invention. It is for instance possible to position an annular weir, whose diameter lies between that of the central tube and that of the reactor wall, in the annular fluidized bed such that the upper edge of the weir protrudes beyond the solids level obtained during operation, whereas the lower edge of the weir is arranged at a distance from the gas distributor or the like. Thus, solids separated out of the mixing chamber in the vicinity of the reactor wall must first pass by the weir at the lower edge thereof, before they can be entrained by the gas flow of the central tube back into the mixing chamber. In this way, an exchange of solids is enforced in the annular fluidized bed, so that a more uniform retention time of the solids in the annular fluidized bed is obtained.

Developments, advantages and possible applications of the invention can also be taken from the following description of embodiments and the drawing. All features described and/or illustrated form the subject-matter of the invention per se or in any combination, independent of their inclusion in the claims or their back-reference.

DETAILED DESCRIPTION OF THE PREFERRED EMBODIMENTS

Figure 1:
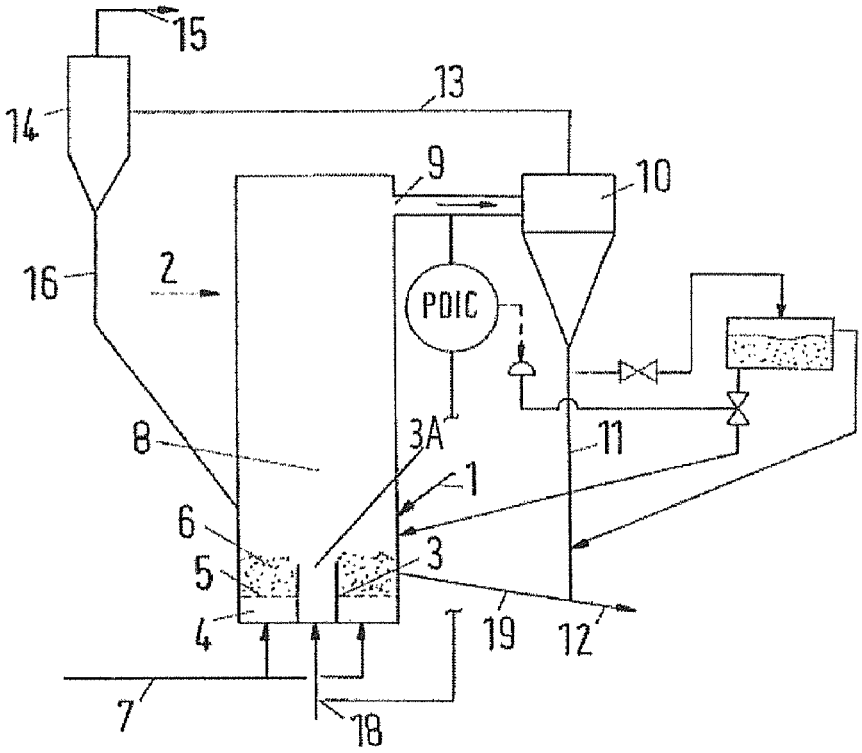
FIG. 1 shows a process diagram of a method and a plant in accordance with a first embodiment of the present invention.

In the method for producing low-temperature coke without further solids, which is shown in FIG. 1, fine-grained coal with a grain size of less than 10 mm is charged into the low-temperature carbonization reactor 2 via conduit 1. In its lower central region, the reactor 2 has a vertical central tube 3 which is surrounded by a chamber 4 which is annularly formed In cross-section. The chamber 4 is divided into an upper part and a lower part by a gas distributor 5. While the lower chamber acts as gas distributor chamber for fluidizing gas, a stationary fluidized bed 6 (annular fluidized bed) of fluidized coal is located in the upper part of the chamber, the fluidized bed extending a bit beyond the upper orifice end 3A of the central tube 3

Through conduit 7, air is supplied to the annular fluidized bed 6 as fluidizing gas, which flows through the gas distributor chamber and the gas distributor 5 into the upper part of the annular chamber 4, where it fluidizes the coal to be subjected to low-temperature carbonization by forming a stationary fluidized bed 6. The velocity of the gases supplied to the reactor 2 preferably is chosen such that the Particle-Froude-Number in the annular fluidized bed 6 is between 0.12 and 1.

Through the central tube 3 air is likewise constantly supplied to the low-temperature carbonization reactor 2, which air upon passing through the central tube 3 flows through the mixing chamber region 8 and the upper duct 9 into the cyclone 10. The velocity of the gas supplied to the reactor 2 preferably is adjusted such that the Particle-Froude-Number in the central tube 3 is between 6 and 10. Due to the high velocity, the air flowing through the central tube 3 entrains solids from the stationary annular fluidized bed 6 into the mixing chamber region 8 upon passing through the upper orifice region 3A, so that an intensively mixed suspension is formed. As a result of the reduction of the flow velocity by the expansion of the gas jet and/or by impingement on one of the reactor walls, the entrained solids quickly lose velocity and fall back into the annular fluidized bed 6. Only a small amount of non-precipitated solids is discharged from the low-temperature carbonization reactor 2 together with the gas stream via the duct 9. Thus, between the reactor regions of the stationary annular fluidized bed 6 and the mixing chamber 8 a solids circulation is obtained, by means of which a good mass and heat transfer is ensured. The solids retention time in the reactor can be adjusted within wide limits by the selection of height and outside diameter of the annular fluidized bed 6. Solids separated in the cyclone 10 are fed into the product discharge conduit 12 via conduit 11, whereas the still hot exhaust gas is supplied via conduit 13 into another cyclone 14, separated there from possibly remaining solids, and withdrawn via an exhaust gas conduit 15. Solids separated in the cyclone 14 are supplied again to the reactor 2 via conduit 16 for low-temperature carbonization.

Optionally, as shown in FIG. 1, part of the solids discharged from the reactor 2 and separated in the cyclone 10 can be recirculated to the annular fluidized bed 6. The amount of the product stream recirculated to the annular fluidized bed 6 can be controlled in dependence on the pressure difference above the mixing chamber 8 ($\Delta p_{MC}$).

The process heat required for low-temperature carbonization is obtained by partial oxidation of the constituents of the coal.

Part of the low-temperature coke is continuously withdrawn from the annular fluidized bed 6 of the low-temperature carbonization reactor 2 via conduit 19, mixed with the product discharged from the cyclone 10 via conduit 11, and withdrawn via the product conduit 12.

Figure 2:
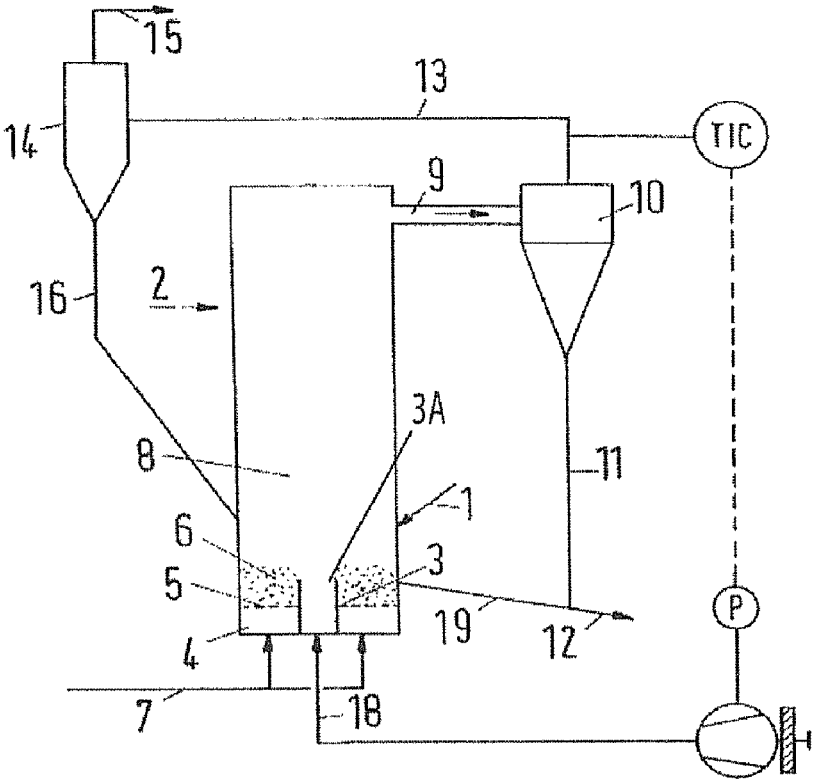
FIG. 2 shows the process diagram of a plant as shown in FIG. 1 with a temperature control of the reactor.

As shown in FIG. 2, the temperature of the reactor can be controlled by varying the volume flow of the fluidizing air. The more oxygen ($O_2$) is supplied, the more reaction heat is produced, so that a higher temperature is obtained in the reactor. Preferably, the volume flow through conduit 7 is kept constant, whereas the volume flow supplied to the central tube 3 is varied by conduit 18, for instance by means of a blower 22 with spin controller.

In contrast to the apparatus described above, the plant shown in FIG. 3, which can in particular be used for producing a mixture of low-temperature coke and iron ore, includes a suspension heat exchanger 20 upstream of the reactor 2, In which granular iron ore introduced through conduit 21, preferably exhaust gas from the cyclone 10 downstream of the low-temperature carbonization reactor 2, is suspended and heated, until a large part of the surface moisture of the ore is removed. By means of the gas stream, the suspension is subsequently introduced via conduit 13 into the cyclone 14, in which the iron ore is separated from the gas. Thereupon, the separated preheated solids are charged through conduit 16 into the low-temperature carbonization reactor 2.

Figure 3:
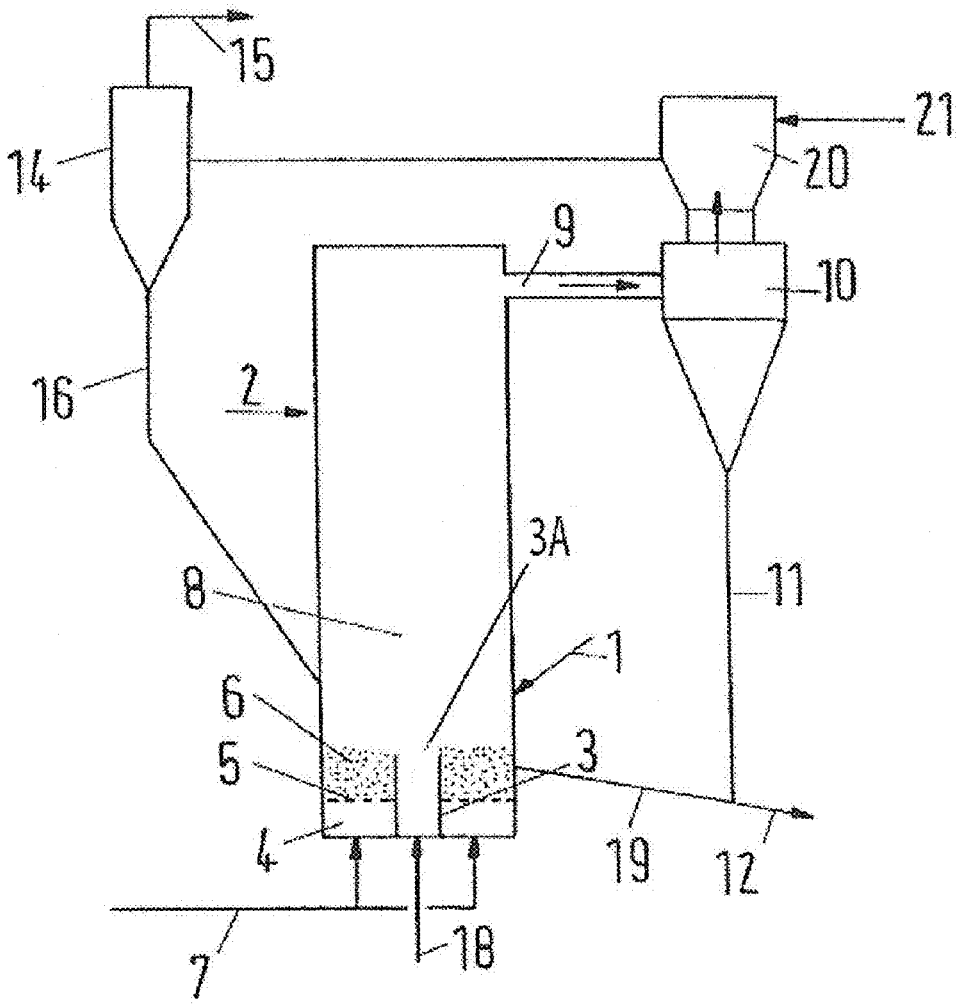
FIG. 3 shows a process diagram of a method and a plant in accordance with a further embodiment of the invention.

The pressure-controlled partial recirculation shown in FIGS. 1 and 2 and the temperature control can of course also be employed in the plant as shown in FIG. 3. On the other hand, the pressure and/or temperature control can also be omitted in the plant as shown in FIGS. 1 and 2.

In the following, the invention will be explained with reference to two examples demonstrating the invention, but not restricting the same.

EXAMPLE 1

Low-temperature Carbonization without Addition of Ore

In a plant corresponding to FIG. 1, 128 t/h coal with a grain size of less than 10 mm with 25.4 wt-% volatile components and 16 wt-% moisture was supplied to the low-temperature carbonization reactor 2 via conduit 1.

Through conduits 18 and 7, 68,000 $Nm^3/h$ air were introduced into the reactor 2, which air was distributed over conduit 18 and conduit 7 (fluidizing gas) in a ratio of 0.74:0.26. The temperature in the low-temperature carbonization reactor 2 was 900° C.

From the reactor 2, 64 t/h low-temperature coke were withdrawn via conduit 12, which coke consisted of 88 wt-% char and 12 wt-% ash. Furthermore, 157,000 $Nm^3/h$ process gas with a temperature of 900° C. were withdrawn via conduit 15, which process gas had the following composition:

| | |
|---|---|
| 11 | vol-% CO |
| 10 | vol-% $CO_2$ |
| 24 | vol-% $H_2O$ |
| 20 | vol-% $H_2$ |
| 1 | vol-% $CH_4$ |
| 34 | vol-% $N_2$. |

EXAMPLE 2

Low-temperature Carbonization with Preheating of Ore

In a plant corresponding to FIG. 3, 170 t/h iron ore were supplied to the suspension heat exchanger 20 via conduit 21 and upon separating gas in the cyclone 14 charged into the low-temperature carbonization reactor 2 via conduit 16. Furthermore, 170 t/h granular coal with 25.4 wt-% volatile constituents and 17 wt-% moisture were supplied to the reactor 2 via conduit 1.

Via conduits 18 and 7, 114,000 $Nm^3/h$ air were introduced into the reactor 2, which air was distributed over conduits 18 and 7 (fluidizing gas) in a ratio of 0.97:0.03. The temperature in the low-temperature carbonization reactor 2 was adjusted to 950° C.

From the reactor 2, 210 t/h of a mixture of low-temperature coke and iron ore were withdrawn via conduit 12, which mixture consisted of

| | |
|---|---|
| 16 | wt-% $Fe_2O_3$ |
| 49 | wt-% FeO |
| 28 | wt-% char, and |
| 7 | wt-% ash. |

Furthermore, 225,000 $Nm^3/h$ process gas with a temperature of 518° C. were withdrawn from the plant via conduit 15, which process gas had the following composition:

| | |
|---|---|
| 11 | vol-% CO |
| 11 | vol-% $CO_2$ |
| 22 | vol-% $H_2O$ |
| 15 | vol-% $H_2$ |
| 1 | vol-% $CH_4$ |
| 40 | vol-% $N_2$. |

LIST OF REFERENCE NUMERALS

1 solids conduit
2 low-temperature carbonization reactor
3 gas supply tube (central tube)
3A upper orifice end/region
4 annular chamber
5 gas distributor
6 annular fluidized bed
7 supply conduit for fluidizing gas
8 mixing chamber
9 duct
10 first cyclone
11 solids discharge conduit
12 product discharge conduit
13 conduit
14 second cyclone
15 exhaust gas conduit
16 supply conduit for preheated solids
18 gas stream conduit
19 solids discharge conduit
20 suspension heat exchanger
21 supply conduit for ore
22 blower

The invention claimed is:

1. A method of producing low-temperature coke, in which granular coal is heated to a temperature of 700 to 1050° C. in a fluidized-bed reactor by an oxygen-containing gas, comprising:

introducing from below a first gas or gas mixture through at least one gas supply tube with an upper orifice into a mixing chamber of the fluidized-bed reactor so as to entrain solids from a stationary annular fluidized bed into the mixing chamber when passing through the upper orifice, the at least one gas supply tube being at least partly surrounded by the stationary annular fluidized bed extending beyond the upper orifice, the solids being entrained from the stationary annular fluidized bed extending beyond the upper orifice upon the first gas or gas mixture passing through an upper orifice region;

fluidizing the stationary annular fluidized bed by supplying fluidizing gas; and adjusting gas velocities of the first gas or gas mixture and the fluidizing gas for the stationary annular fluidized bed such that the Particle-Froude-Number is a) in the at least one gas supply tube between 1 and 100, b) in the stationary annular fluidized bed between 0.02 and 2, and c) in the mixing chamber between 0.3 and 30.

2. The method as claimed in claim 1, wherein the Particle-Froude-Number in the at least one gas supply tube is between 1.15 and 20.

3. The method as claimed in claim 1 wherein the Particle-Froude-Number in the stationary annular fluidized bed is between 0.115 and 1.15.

4. The method as claimed in claim 1, wherein the Particle-Froude-Number in the mixing chamber is between 0.37 and 3.7.

5. The method as claimed in claim 1, wherein solids are discharged from the fluidized-bed reactor and separated in a separator, wherein part of the solids or an amount of a product stream are recirculated to the stationary annular fluidized bed.

6. The method as claimed in claim 5, wherein the amount of the product stream recirculated to the stationary annular fluidized bed is controlled by a difference in pressure above the mixing chamber.

7. The method as claimed in claim 1, wherein granular coal having a grain size of less than 10 mm is supplied to the fluidized-bed reactor as a starting material.

8. The method as claimed in claim 1, wherein granular coal is a highly volatile coal and the highly volatile coal is supplied to the fluidized-bed reactor as starting material.

9. The method as claimed in claim 1, wherein the fluidizing gas supplied to the fluidized-bed reactor is air.

10. The method as claimed in claim 1, wherein the pressure in the fluidized-bed reactor is between 0.8 and 10 bar.

11. The method as claimed in claim 1, wherein iron ore is additionally supplied to the fluidized-bed reactor.

12. The method as claimed in claim 11, wherein the iron ore is preheated before being supplied to the fluidized-bed reactor.

13. The method as claimed in claim 11, wherein the iron ore and low-temperature coke withdrawn from the fluidized-bed reactor has a weight ratio of iron to carbon of 1:1 to 2:1.

14. A plant for producing low-temperature coke by the method recited in claim 1, comprising a fluidized-bed reactor, wherein the fluidized-bed reactor includes:

at least one gas supply system tube with an upper orifice at least partially surrounded by an annular chamber in which a stationary annular fluidized bed is located, wherein the stationary annular fluidized bed extends beyond the upper orifice, so that a first gas or gas mixture flowing through the at least one gas supply tube entrains solids from the stationary annular fluidized bed into the mixing chamber when passing through the upper orifice; and a mixing chamber located above the upper orifice of the at least one gas supply tube.

15. The plant as claimed in claim 14, wherein the has at least one gas supply tube in the lower region of the fluidized-bed reactor extends upwards substantially vertically into the mixing chamber of the fluidized-bed reactor.

16. The plant as claimed in claim 15, wherein the at least one gas supply tube is arranged approximately centrally with reference to the crosssectional area of the fluidized-bed reactor.

17. The plant as claimed in claim 14, wherein downstream of the fluidized-bed reactor there is provided a separator for separating solids, which has a solids return conduit leading to the annular fluidized bed of the fluidized-bed reactor.

18. The plant as claimed in claim 14, wherein in the annular chamber of the fluidized-bed reactor, a gas distributor is provided, which divides the annular chamber into an upper fluidized bed region and a lower gas distributor chamber, and wherein the gas distributor chamber is connected with a supply conduit for fluidizing gas.

19. The plant as claimed in claim 14, wherein upstream of the fluidized-bed reactor, a preheating stage is provided, which consists of a heat exchanger and a separator.

* * * * *